US006270555B1

(12) United States Patent
Wood et al.

(10) Patent No.: US 6,270,555 B1
(45) Date of Patent: Aug. 7, 2001

(54) PROCESS FOR TREATING PRECIOUS METAL ORES

(75) Inventors: Michael D. Wood, Kingwood, TX (US); Richard K. DeSomber, Lombock (ID); Danial L. Marshall, Spring Creek, NV (US)

(73) Assignee: Solvay Minerals, Inc., Houston, TX (US)

( * ) Notice: Subject to any disclaimer, the term of this patent is extended or adjusted under 35 U.S.C. 154(b) by 0 days.

(21) Appl. No.: 09/627,928

(22) Filed: Jul. 28, 2000

Related U.S. Application Data

(60) Provisional application No. 60/174,086, filed on Dec. 30, 1999.

(51) Int. Cl.[7] ..... C22B 1/06
(52) U.S. Cl. ..... 75/751; 423/47
(58) Field of Search ..... 75/751; 423/47

(56) References Cited

U.S. PATENT DOCUMENTS

| | | | | |
|---|---|---|---|---|
| 4,034,063 | * | 7/1977 | Rosar et al. | 75/712 |
| 4,188,208 | | 2/1980 | Guay . | |
| 4,259,107 | | 3/1981 | Guay . | |
| 4,902,345 | | 2/1990 | Ball et al. . | |
| 4,919,715 | | 4/1990 | Smith et al. . | |
| 4,979,986 | | 12/1990 | Hill et al. . | |
| 5,002,741 | | 3/1991 | Hooper . | |
| 5,123,956 | | 6/1992 | Fernández et al. . | |
| 5,215,575 | | 6/1993 | Butler . | |
| 5,261,945 | | 11/1993 | Awadalla . | |
| 5,279,802 | | 1/1994 | Clough . | |
| 5,279,803 | | 1/1994 | Clough . | |
| 5,851,499 | | 12/1998 | Gathje et al. . | |

FOREIGN PATENT DOCUMENTS 0 360 555 A1 9/1989 (EP) .

OTHER PUBLICATIONS

Brittan M "Oxygen Roasting of Refractory Gold Ores" *Min. Eng* pp. 145–148 Feb. 1995.*

Brittan, Michael, "Oxygen Roasting of Refractory Gold Ores," Mining Engineering, pp. 145–148, Feb. 1995.

Bunk, Stanley A. and Bruyns, Desmond J., "Review of the State of the Commercial Art in Roasting," Randol, Beaver Creek '93, pp. 175–178 (1993).

DeSomber, R. Kevin, Fernández, René, McAnany, Laura; Stolarski, Dr. E. and Schmidt, G., "Refractory Ore Treatment Plant at Newmonth Gold Company," Randol Gold Forum '96, pp. 239–247 (1996).

Luganov, V.A., Plakhin, G.A., Luganov, A.V., Gorbatenko, G.V., "Oxidizing Roasting of Arsenic Gold Bearing Concentrates with the Soda Presence," Randol Gold Forum '96, pp. 253–256 (1996).

Sporleder, Lisa E., "Newmont New Projects, New Methods, New Mines," E&MJ, pp. N10–N22, Jan. 1989.

Taylor, P.R. and Yin, Z–B, "Soda Ash Roasting of As–Sb–Precious Metal Concentrates," Minerals and Metallurgical Processing, pp. 163–196, Nov. 1993.

Weeks, Tony, McGaffin, Ian, and Loah, J., "Operational Aspects of Whole Ore Treatment at PT Newmont Minahasa Raya," Randol Gold & Silver Forum '98, pp. 227–233 (1998).

* cited by examiner

*Primary Examiner*—Melvyn Andrews
(74) *Attorney, Agent, or Firm*—Brinks Hofer Gilson & Lione

(57) ABSTRACT

This invention provides a method to control the off gas emission of sulfur dioxide from a mineral ore roaster by grinding a sulfur-containing mineral ore, adding sodium sesquicarbonate to the mineral ore, and roasting the ore and sodium sesquicarbonate at an elevated temperature.

25 Claims, No Drawings

PROCESS FOR TREATING PRECIOUS METAL ORES

This application claims benefits to U.S. provisional application 60/174,086, filed Dec. 30, 1999.

BACKGROUND OF THE INVENTION

This invention relates to recovering precious metal values from refractory ores, which include carbon- and sulfur-containing components, and to the control of environmental emissions during the treatment of those ores. In particular, this invention relates to a method of roasting those ores.

The purpose of roasting precious metal ores, such as gold ore, is to release for extraction the small particles of precious metal that are surrounded by refractory stone or minerals. Refractory refers to non-conventional ores, such as oxide, which implies extreme process measures must be taken to extract the metal. The roasting simply opens up passages for the penetration of a leaching solution into the interior of the ore particles. This is accomplished by the removal by volatilization or formation of volatile oxides of certain constitutents such as sulfur, arsenic or antimony.

For example, the gold in refractory sulfide ores is angstrom-sized and physically locked in the arsenian pyrite mineral species. Roasting of this ore oxidizes the sulfide mineral and changes the structure, which allows the cyanide leaching solution to come into contact with the gold. Temperature is an important parameter. High temperatures tend to form a dense particle rather than a "spongy" calcine. The dense particles trap the smaller precious metal particles, and result in lower metal recoveries. High temperature can cause melting of some components, which also results in metal encapsulation.

In the case of recovering gold from gold ores, roasting of refractory gold ore concentrates has been practiced for decades. Multiple hearth, rotary kiln and muffle reactors were first used for roasting. Fluid bed roasting provided a low-capital cost, low-maintenance technology with better process control and soon became the favored technology. The first fluid bed concentrate roasters were commissioned in the late 1940's. Early fluid beds were "bubbling" type. Environmental considerations did not significantly impact on the design. Feedstocks were highly exothermic and reaction rates were relatively rapid.

Roasting today must compete with other technologies for treatment of refractory ores. Ore bodies which are not amenable to concentration must be handled. Foremost, processing must be done in an environmentally acceptable manner.

Table 1 presents some of the minerals commonly present in refractory gold ores. Many of these minerals include sulfur and other elements that may require costly processing and disposal. In addition, ores may contain organic carbon. This carbon may have "preg robbing" characteristics, which takes up or "robs" the solubilized gold from being recovered during gold leaching operations.

TABLE 1

MINERAL ASSOCIATED WITH GOLD ORES

| NON-SULFIDIC | | SULFIDIC | |
|---|---|---|---|
| Name | Formula | Name | Formula |
| Quartz | $SiO_2$ | Pyrite | $FeS_2$ |
| Dolomite | $CaCO_3.MgCO_3$ | Pyrrhotite | $Fe_5S_6$ to $Fe_{16}S_{17}$ |
| Calcite | $CaCO_3$ | Arsenopyrite | FeAsS |
| Muscovite | $K_2O.2Al_2O_3.6SiO_2.2H_2O$ | Orpiment | $As_2S_3$ |
| Albite | $Na_2O.Al_20_3.6SiO_2$ | Realgar | AsS |
| Talc | $3MgO.4SiO_2.H_2O$ | Tetrahedrite | $4Cu_2S.Sb_2S_3$ |
| Clay | $Al_2O_3.(x)SiO_2.(y)H_2O$ | Chalcopyrite | $CuFeS_2$ |
| Calaverite | $AuTe_2$ | Sphalerite | ZnS |
| Petzite | $Ag_3AuTe_2$ | Galena | PbS |
| Gold | Au | Stibnite | $Sb_2S_3$ |
| Scorodite | $FeAsO_4.2H_2O$ | Enargite | $Cu_3AsS_4$ |
| Selenium | Se | Cinnabar | HgS |

Environmental issues which must be addressed are primarily the fate of the sulfur gases, arsenic, and mercury. Other pollutants such as antimony may be important depending on the specific ore mineralogy.

High concentrations of sulfur gases, primarily sulfur dioxide, will be present in the exhaust gases from all concentrate roasters. Generally, the concentration of these sulfur oxide gases should be substantially reduced prior to discharge to atmosphere. One option is the manufacture of sulfuric acid. A second option would be a wet scrubbing system using alkali. Because of the low value of sulfuric acid, very few plants utilize the first option; however, that decision also depends on the availability of a market for the sulfuric acid, and the cost to dispose of the sulfur otherwise.

In the case of concentrates with high arsenic contents efforts have been made to volatize the arsenic as arsenic trioxide. This results in higher gold recoveries. There are several technologies available for the removal of arsenic trioxide from the exhaust gases.

The roasting of whole or unconcentrated ores has also been commercialized. There are several characteristics of the whole ores that differ from concentrates, which significantly affect design. The ore has a low heating value. Dry feeding of the ore is required, whereas most concentrates are fed in a slurry form. Reaction rates are slower with whole ores, thus requiring long solids retention time. Whole ore, as opposed to concentrates, can have a higher variability in the amount of sulfur, and therefore requires blending of different ore lots to the roaster feed. But, blending ores to obtain consistent overall sulfur content can be problematic, and therefore, alternative methods may be required to help control $SO_2$ content.

Because the sulfur gases may cause some environmental problems, there must be additional processing steps taken with whole ore roasting to meet regulatory compliance. One solution is to scrub the roaster off gases with an alkali. But, whole ore roasting produces more dilute $SO_2$ gases, and dilute gases are difficult to scrub and remove. Another solution that has been practiced is to add lime in the roaster to capture the sulfur "in situ," i.e. by forming solid sulfates. Yet another solution suggested has been to add soda ash (sodium carbonate) in the roaster to control the $SO_2$ emissions. In some applications, however, soda ash may cause other problems such as generation of fines, due to its friability.

With low gold prices, the cost of those chemicals becomes more expensive relative to the value of the gold being recovered from the ore. Thus, there is a need for other solutions to the environmental issues that are more cost effective, and offer potential benefits of enhancing the recovery of the precious metals.

SUMMARY OF THE INVENTION

Accordingly, the present invention provides, in one embodiment, a method for treating precious metal ores having sulfur-containing components. The method includes grinding the ore, adding sodium sesquicarbonate to the ore, roasting the ore and sodium sesquicarbonate at an elevated temperature sufficient to oxidize the sulfur-containing components, and recovering the precious metal value from the roasted ore. Preferably, the sodium sesquicarbonate is in the form of mechanically refined trona, which is added to the ore before the ore is ground.

In a second embodiment, the invention provides a method for treating sulfur-containing precious metal ores, ore concentrates or mixtures thereof by adding sodium sesquicarbonate to the ore, roasting the ore in the presence of sodium sesquicarbonate, measuring the sulfur dioxide in the off gas generated by the roasting, and adjusting the amount of sodium sesquicarbonate added to the ore, and recovering the roasted ore.

In a third embodiment, the invention provides a method for controlling off gas emissions from a mineral ore roaster by introducing a mineral ore into a roaster, introducing sodium sesquicarbonate into the roaster, and roasting the ore and sodium sesquicarbonate at a temperature sufficient to fix any sulfidic material in the ore and fix at least some of the resultant sulfur dioxide.

It has recently been found that trona, or natural sodium sesquicarbonate, when added with ore to a roaster is more effective than lime or soda ash at controlling $SO_2$ emissions. Also, in some applications, using trona in the roaster has improved the recovery of gold from certain gold-containing ores. These and other advantages will be apparent from the detailed description that follows.

DETAILED DESCRIPTION OF THE PRESENTLY PREFERRED EMBODIMENTS

Trona is a mineral ore that usually contains 70–95% of a complex salt of sodium carbonate ($Na_2CO_3$) and sodium bicarbonate ($NaHCO_3$) in a hydrated crystal form known as sodium sesquicarbonate ($Na_2CO_3.NaHCO_3.2H_2O$). Trona also contains between 6–30% insolubles, usually shale oil, and a small amount of NaCI, usually less than 0.3%. A vast deposit of trona is found in southwestern Wyoming, near Green River. The trona in that deposit typically contains between 90–95% sodium sesquicarbonate. But, trona deposits exist elsewhere with a lower sodium sesquicarbonate concentration of between 10–50% by weight.

Trona ore can be mined and mechanically refined to different particle size distributions useful for different applications. Trona can also be chemically refined and processed into sodium sesquicarbonate, soda ash ($Na_2CO_3$), sodium bicarbonate ($NaHCO_3$) and other alkali materials. Unless otherwise specifically noted herein, usage of the term trona refers to raw trona ore, mechanically refined trona or sodium sesquicarbonate.

In a broad aspect of the invention, trona can be added to a roaster to control the $SO_2$ emissions derived from oxidation of the sulfur-containing components in the mineral ore. In a narrow aspect of the invention, trona can be added to a roaster feed with gold ores to improve downstream gold extraction.

In a first embodiment of the invention, a method is provided to control the off gas emissions from a mineral ore roaster. The method includes grinding a sulfur-containing mineral ore, adding sodium sesquicarbonate to the mineral ore, and roasting the mineral ore and sodium sesquicarbonate at an elevated temperature sufficient to oxidize the sulfidic material contained in the ore and sufficient to fix at least some of the resultant sulfur dioxide.

Preferably, the sodium sesquicarbonate is in the form of mechanically refined trona. Preferably, the mechanically refined trona has a particulate size distribution such that about 10 weight percent of the trona is retained on a 30 mesh screen and/or about 86 weight percent of the trona is retained on a 100 mesh screen. As discussed further below, a trona product having this particulate size distribution is commercially available from Solvay Minerals, Inc. of Houston, Texas, and is sold under the trade name Solvay T-50. Preferably, the roasting is conducted at a temperature between about 475° C. and about 750° C. More preferably, the temperature is between about 500° C. and about 625° C. Even more preferably, the temperature is between about 550° C. and 600° C.

Preferably, the sodium sesquicarbonate or trona is added to the mineral ore before grinding the mineral ore. This helps to achieve intimate mixing of the materials before roasting, which may reduce the amount of trona additive required to achieve the same results compared to adding trona after the grinding step. Preferably, the amount of sodium sesquicarbonate or trona added to the mineral ore is less than about kilograms of sodium sesquicarbonate per metric ton (tonne) of mineral ore. More preferably, the amount of sodium sesquicarbonate or trona is more than about 2 kilograms per metric ton of mineral ore. Preferably, the method is used for controlling off gas emissions from a gold ore, where the gold ore is preferably a refractory sulfide gold ore.

In a second embodiment of the invention, a method is provided for treating mineral ore, ore concentrates, or combinations thereof having recoverable precious metal values and including sulfur-containing components. This method includes adding sodium sesquicarbonate to the mineral ore, ore concentrates or combinations thereof, roasting the mineral ore, ore concentrates, or combinations thereof in the presence of sodium sesquicarbonate at elevated temperatures sufficient to oxidize the sulfur-containing components. Preferably the sodium sesquicarbonate is present in amounts sufficient to fix at least a portion of the sulfur dioxide created by oxidation of the sulfur-containing components. The method also includes measuring the concentration of sulfur dioxide in the off gas generated by the roasting step, and adjusting the amount of sodium sesquicarbonate added to the mineral ore, ore concentrates or combinations thereof in response to the difference between the measured concentration of sulfur dioxide and a predetermined concentration of sulfur dioxide. The method includes recovering the roasted ore as a calcine whereby the precious metal value may be recoverable from the calcine.

Preferably, the sodium sesquicarbonate is in the form of mechanically refined trona, where the trona preferably has a particulate size such that about 86 weight percent of the trona is retained on a 100 mesh screen. Preferably, the method includes grinding the trona and the mineral ore, ore concentrates or combinations thereof together before roasting the mixture. Preferably, the trona and the mineral ore mixture are ground to a particulate size such that about 68 weight percent will pass through a 400 mesh screen. Preferably, the mixture is roasted at a temperature between about 475° C. and about 750° C., more preferably at a temperature of between about 500° C. and about 625° C., even more preferably at a temperature between about 550° C. and about 600° C.

Preferably, this method is operated with a predetermined concentration of sulfur dioxide between about 4% and about 12%. More preferably, the predetermined concentration of sulfur dioxide is between about 8% and about 10%, and even more preferably at about 9.5%. Preferably, the trona is added in an amount less than about kilograms per metric ton of mineral ore, ore concentrates or combinations thereof. More preferably, the trona is added in an amount of more than about 2 kilograms per metric ton of mineral ore. The method preferably includes conducting the roasting step in an oxygen-enriched atmosphere. Also, it is preferred that, in contrast to a step-wise batch operation, the method is conducted in a continuous process operation.

In a third embodiment of the invention, a method is provided for controlling the off gas emissions from a mineral ore roaster that includes the steps of introducing a mineral ore containing sulfidic material into a roaster, introducing sodium sesquicarbonate into the roaster, and roasting the mineral ore and sodium sesquicarbonate at an elevated temperature sufficient to oxide the sulfidic material contained in the ore and sufficient to fix at least a portion of the resultant sulfur dioxide. Preferably, the sodium sesquicarbonate is in the form of mechanically refined trona. Preferably, the mineral ore is in the form of an ore concentrate. The preferred temperature for the roasting step is between about 475° C. and about 750° C.

Basically, the foremost factors that cause the refractoriness of pyritic-carbonaceous-siliceous gold ores, and thus require oxidative pretreatment in a roaster, are: (1) the intimate association between gold and sulfides or sulfo-salts (such as of iron, arsenic, antimony, etc.); (2) the association of gold-bearing minerals with carbon or carbonaceous compounds; and, (3) the encapsulation of gold-bearing minerals within host rock (such as silicates, carbonates, etc.). Extracting the most gold from these ores would therefore require either the destruction of the associated minerals and/or the release of gold and its associations from the physical barrier that prevents them from responding to cyanidation.

The use of trona as a roaster feed additive affords a solution to two of the three problems mentioned above. First, trona "fixes" the sulfides in the ore. The use of the terms "fix," "fixing," or "fixes" herein is intended to refer generally to what is believed to occur in the roaster, that is, that the sodium sesquicarbonate in the trona reacts with the sulfide or sulfur dioxide formed from the sulfide to form a sodium sulfate solid, rather than allowing the sulfide to escape as $SO_2$ gas. Second, trona is believed to be a flux that lowers the melting point of solids, and in doing so allows structural changes that could result in coalescence of dissolved gold by diffusion, the destruction of encapsulating material or conversion of such material to more soluble forms. These are properties that have long been recognized in fire assaying and other methods of chemical analysis, but not obvious as practical for processing large quantities of other material.

Trona, however, is not an oxidizer of carbon. Fundamentally, such an imagined system where carbon is oxidized by trona is chemically impossible, since there is nothing else in the system that is available for the corresponding reduction reaction (redox couple). Therefore, for roasting ores, it is considered theoretically impossible for trona to have an effect on the carbon "preg robbing" problem.

Nevertheless, other effects caused by trona addition in the roaster feed are not apparent until the downstream stages of processing. One example, if the roasting temperature is high enough, is the conversion of normally insoluble silicates to easily soluble forms through the fluxing action of trona. This will cause the release of gold from encapsulation and result in easier exposure to the cyanide lixiviant. There are also potential advantages in that trona modifies the conductivities of particulates and of solutions to cause increased performance efficiencies of the electrostatic precipitators at the gas cleaning plant.

Because of the downstream effects of trona addition to the roaster, it may be useful to present a detailed understanding of the complete roasting process of gold ore in a representative commercial roasting recovery operation. Studies of trona addition to such an operation have been conducted at Newmont Gold Company operations in Carlin, Nev. Those basic operations using lime addition to the roaster, rather than trona, have been described by DeSomber, R. K, et al., "Refractory Ore Treatment Plant at Newmont Gold Company," Randol Gold Forum '96, pp. 240–247 (1996), and are briefly repeated here.

As previously described, the overall gold ore roasting process at Newmont's Carlin, Nev., operations includes a grinding operation, an ore preheating operation, a roasting operation, a gas cleaning operation, and a sulfuric acid plant. The roasted ore is subsequently processed in a carbon-in-leach operation to recover the gold.

The Carlin roaster circuit has a design capacity of about 9000 dry tons per day (tpd) of feed. This feed is a varying mixture of open pit ore and underground ore from Carlin, and gold-pyrite flotation concentrate from the Lone Tree operation. The sulfur content of the feed to the roaster plant varies widely. It is desirable to maintain an $SO_2$ concentration of 8–10% in the roaster off gas that is fed to the sulfuric acid plant downstream from the roaster. As the sulfur content of the mineral ore feed increases, it becomes necessary to either cut back the mineral ore feed rate or absorb some of the sulfur gases produced into the acid plant feed matrix.

The Crushing/Grinding Operation: Refractory gold ore is available from numerous deposits currently mined as well as from large stockpiles. An ore blend based on sulfide sulfur and organic carbon content is fed to the crushing circuit. The crushing circuit consists of a jaw crusher which discharges minus 6-inch material into a secondary crusher with a Tyler double-deck vibrating screen.

Crushed ore is mixed with pyrite concentrates to augment ore fuel values. Fuel value is defined as the amount of heat that can be expected in the roaster due to sulfide sulfur, pyrite, and/or organic carbon. Lime may be added to the feed to control the $SO_2$ emissions from the drying and grinding process.

The dry grinding system operates under negative pressure in closed circuit with two air classifiers. Nominal 1-inch material is delivered to the drying chamber and combined with combustion gases from a hot gas generator. Ore discharges from the drying chamber through a grate into the primary grind compartment where 100 mm (4 inch) balls are added to maintain the ball charge. Also, hydrated lime is added to the ore at this point at an average rate of 19.75 lbs./short-ton of ore. Products from the primary chamber discharge through 1-inch grates and combine with product from the fine chamber at the mill's central outlet. Fine grinding is achieved in the secondary chamber with 60 mm (2.4 inch) balls.

Coarse material from the mill discharge is transferred to a bucket elevator via an air slide. Combustion gases from the burner and fine material carried by the air stream are swept into a static classifier. Coarse particles in the air stream are captured in the static classifier and re-routed to the bucket elevator. Fine material from the static classifier, representing approximately percent of the mill feed, is collected in a cluster of four bag-houses and discharged into the fine-ore-bin. The bucket elevator discharges onto an air slide that feeds a dynamic separator. Roughly 70 percent of the coarse material from the dynamic separator is returned to the secondary grind compartment where 60 mm (2.4 inch) balls are added. The remaining 30 percent of the coarse material is returned to the drying chamber.

The fines from the dynamic separator are collected in a second cluster of four baghouses and discharged into the fine-ore-bin. Fine-ore-bin storage discharge is routed to a distribution box that feeds the North and South roaster train bucket elevators.

The Ore Preheating Operation: Finely ground refractory ore (approximately 100 percent minus 208 microns) is delivered to an impact weight scale for measuring the feed rate. After the scale, the ore flows down an inclined feed chute into the preheater.

The preheater system includes the following major pieces of equipment: CFB ore preheater, two cyclones, two seal pots, induced-draft fan, and two primary air blowers. Ore is preheated to a maximum of 420° F. by primary air that enters the bottom of the CFB preheater at a design of 815° F. Primary air from the two air blowers is heated by an in-duct burner just ahead of the preheater.

The CFB ore preheater drives off the moisture in the ore (to less than 1 percent) with an average retention time ranging from 2 to 5 minutes. Two cyclones and two seal pots are installed for solids recirculation. A portion of the ore recycles into the preheater, and the balance is discharged through a lance directly to the roaster. Entrained solids in the gas leaving the cyclones are captured in a single baghouse and sent to the roaster.

The preheater operating temperatures may result in partial oxidation of sulfide minerals to sulfur dioxide. Therefore, exhaust gases from the baghouses of both ore preheaters are combined and sent through a caustic scrubber to control $SO_2$ emissions. A portion of the de-dusted exhaust gases (at approximately 400° F.) can bypass the caustic scrubber and be recycled to the grinding circuit in order to reduce the natural gas consumption in the dry grinding process.

The Roasting Operation: Newmont Gold Company has two roasting trains that are totally independent of one another. Each roaster is an integrated system consisting of a Circulating Fluidized Bed (CFB) roaster, two cyclones, two seal pots, fluidizing air blowers, oxygen preheater, in-duct burner and two calcine coolers. The roasters run at approximately 1,000° F. and a retention time of about five to six minutes, with a maximum retention time of minutes. Plant experience has shown that nearly all of the sulfide mineralization and approximately percent of the organic carbon is oxidized in the roaster. Additional retention time of 18 to 24 minutes at temperature is provided in the calcine coolers where the balance of the organic carbon is oxidized. The calcine product is quenched at 15 percent solids by weight and the warm slurry (at 104° F.) undergoes neutralization with milk of lime, thickening, and conventional carbon-in-leach processing. A typical mineralogical and chemical composition of roaster feed follows in Table 2:

TABLE 2

Mineralogical and Chemical Compositions

| | Design | Low | High |
|---|---|---|---|
| Pyrite, % | 3 | 2 | 4 |
| Quartz, % | 71 | 65 | 78 |
| Sericite, % | 5 | | |
| Kaolinite, % | 11 | | |
| Alunite, % | 3 | | |
| Jarosite, % | 5 | | |
| Organic Carbon, % | 0.4 | 0.4 | 1.0 |
| Carbonate Carbon, % | 0.05 | 0.04 | 0.06 |
| Sulfide Sulfur (as pyrite), % S | 1.73 | 1.25 | 2.50 |
| Silica, % $SiO_2$ | 80 | 72 | 88 |
| Alumina, % $Al_2O_3$ | 7.0 | 6.3 | 7.7 |
| Potassium Oxide, % $K_2O$ | 1.50 | 1.35 | 1.65 |
| Sodium Oxide, % $Na_2O$ | 0.02 | 0.04 | 0.06 |
| Magnesia, % MgO | 0.3 | 0.2 | 0.4 |
| Lime, % CaO | 0.010 | 0.005 | 0.020 |
| Arsenic, ppm As | 1200 | 1100 | 1300 |
| Chloride, ppm Cl | 100 | 90 | 110 |
| Fluorine, ppm F | 1000 | 900 | 1100 |
| Lead, ppm Pb | 25 | 20 | 30 |
| Mercury, ppm Hg | 20 | 18 | 22 |
| Antimony, ppm Sb | 80 | 72 | 88 |
| Zinc, ppm Zn | 1000 | 900 | 1100 |
| Gold, Au ounces per ton | 0.15 | | |

The main source of fuel at the roaster is the sulfide and organic components found in the ore. An in-duct burner was installed to heat the roaster to operating temperatures and provide additional heat during operation. Liquid sulfur may also be injected into the roaster through two lances, not only to provide heat, but also to generate $SO_2$ for acid plant operation while running low sulfide ores. Kerosene lances were installed to provide heat when low organic carbon and high sulfides were being processed.

Off gas from the roaster is first cooled from 1,000° F. to roughly 710° F. in a waste heat boiler. It is then cleaned from 440 grains per standard cubic foot (gr/scj) to 0.0054 gr/scf in a field Electrostatic Precipitator (ESP) and evenly split into either the main roaster fluidization stream or the gas cleaning feed stream. The recycled gas to the roaster contains 30 to 40 percent oxygen by volume and from this point the oxygen concentration is controlled. Certain benefits may be obtained by operating the roaster with an oxygen-enriched gaseous atmosphere as described in U.S. Pat. No. 5,123,956 to Fernandez ct al., which is incorporated by reference herein.

The Gas Cleaning Operations: The primary functions of the gas cleaning plant are to cool the incoming gas stream, adjust water vapor levels for the acid plant, remove acid mist by wet-gas Electro-Static Precipitation (ESP), remove fluorine, remove mercury vapor, and recovery the mercury through electrowinning.

Both parallel roaster trains combine before entering the single gas cleaning plant. Hot gas (710° F.) first enters an adiabatic cooler and flows counter current to scrubbing solutions. Evaporation cools the gas to an exit temperature of 150° F. The gas water saturation levels at this temperature are above levels that can be tolerated in the acid plant. Therefore, the gas is cooled to a temperature less than 90° F. in two parallel, two stage lead lined tube-and-shell heat exchangers.

After the gas exits the gas coolers, it enters the first of two identical wet ESPs to remove small amounts of particulate and more importantly, acid mists. The wet ESPs were fabricated from plastics and depend on a water film to provide the collecting electrodes surface.

Fluoride is removed to prevent deterioration of the acid plants catalyst silica substrate. Gas enters the tower at the bottom and is sent through a packed bed of sacrificial silica saddles. Approximately 80 percent of the fluorine is removed by the chemical reaction with this silica packing. After the fluorine tower the gas then passes through the second ESP identical to the one previously mentioned.

The final step of gas cleaning is the removal of mercury from the gas stream. Mercury is volatilized in the roasting process and reacts with other compounds or condenses during the gas cleaning's cooling and cleaning processes. The mercury tower uses a scrubbing solution of mercuric chloride to complex the gaseous mercury into mercurous chloride (calomel). Calomel is then chlorinated back to mercuric chloride and either returned to the mercury tower or the mercury is recovered by electrowinning.

The Sulfuric Acid Plant: The acid plant can be divided into three main sections: drying and absorption; $SO_2$ converter with gas-to-gas heat exchangers; and, tail gas scrubbing. The acid plant uses a conventional 3 +double absorption system. Process gases go through 3 catalyst beds in the converter and then to the intermediate absorption tower. The gases then go back to the fourth catalyst bed in the converter before going to the final absorption tower.

The acid plant may be operated with between about 4.5% and about 10.5% $SO_2$ in the feed process gas, however, typical feed concentration is about 9.5% $SO_2$.

Process gases enter the acid plant through the drying tower where water vapor is removed by absorption in 94 percent sulfuric acid. Conversion of $SO_2$ to $SO_3$ in the first bed generates excess heat that must be dissipated to avoid temperatures that degrade the catalyst in the second and third beds. To dissipate this heat, the roaster's waste heat boiler steam is super-heated to cool exit gas stream of the first bed. Once cooled the gas passes the second catalyst bed and is then cooled through the tube side of the aforementioned heat exchanger for the first bed. Because CO in the process gas undergoes highly exothernic reaction in the catalyst bed, the $SO_2$ concentration in the feed from the roaster may need to be reduced to maintain the heat balance in the plant.

After exiting the heat exchanger at a temperature between 840 to 850° F., the gas passes through the third catalyst bed. Conversion efficiency for $SO_2$ to $SO_3$ is at approximately 95 percent after the third bed. The gas stream enters the fourth catalyst bed at 770° F. where the remaining $SO_2$ is converted before it enters the final absorption tower. Final $SO_2$ to $SO_3$ conversion is greater than 99.8 percent.

After final absorption, the discharge gases go to a hydrogen peroxide tail gas scrubber to further reduce the $SO_2$ concentration. Approximately 60 percent of the gas from the tail gas scrubber is recycled for fluidizing air in the roasters and purge air for the Hot ESPs. The remainder of the gas is sent to a Regenerative Thermal Oxidizer (RTO) where the remaining CO is oxidized to $CO_2$ to satisfy environmental constraints.

The Gold Recovery Operations: The roasted ore, or calcine, is sent to a quench tank/thickener. The slurry from the tank is pumped to a conventional six-stage carbon-in-leach circuit. The slurry flows by gravity from one tank to the next, while carbon is pumped through the circuit in a counter-current direction. Screens are incorporated into the tank design to allow movement of the slurry while carbon is retained in the tank. The loaded carbon is pumped or trucked to a central carbon stripper unit. A typical carbon-in-leach circuit operation is disclosed in U.S. Pat. No. 4,289,532 to Matson et al., which is incorporated by reference herein.

At the carbon stripper unit, a hot caustic and cyanide solution is used to strip the gold off the carbon. The solution is sent to an electrowinning process. The gold is then stripped off the steel wool cathodes, and retorted and melted into gold bars.

EXPERIMENTAL PROCEDURES

EXAMPLE 1

The gold processing operations at the above-described Carlin plant were conducted with trona addition in the roaster and no lime, soda ash, or other such additives. Raw trona, commercially available as Solvay T-50™ natural sodium sesquicarbonate from Solvay Minerals, Green River, Wyoming, was added to the ore in the grinding mill circuit, in place of hydrated lime, at an average rate of 14 lbs. per short ton of ore (7 kg/tonne). The actual instantaneous rate of trona addition varied between 5 and 25 lbs./ton in response to the measured $SO_2$ concentration in the roaster off gas. The ore and trona were mixed together and then ground to 80% −200 mesh, and 68% −400 mesh (i.e., 80% pass through a 200 mesh screen, and 68% pass through a 400 mesh screen), and ore throughput averaged 8,700 dry short tons per day.

Solvay T-50™natural sodium sesquicarbonate is mechanically refined trona containing between about 90–95% sodium sesquicarbonate, and has a typical bulk density of 69 Ibs/ft$^3$. Solvay T-50 ™ trona has a typical particle size distribution as follows: +20 mesh—0.5%, +30 mesh—10%, +40 mesh—33%, +100 mesh—86%, and +140 mesh—94% (given in U.S. Mesh Screen Sizes and Cumulative Weight Percent retained on the screens). One advantage of using Solvay T-50™ trona in the grinding circuit is that it can be ground to the same size as the gold ore, which is believed to maintain a well distributed mix with the ore in the CFB. Also, because of the sturdy crystal structure of mechanically refined trona, as compared with chemically refined soda ash, which is more friable, fewer fines are carried over to the bag house.

An assay of the ore feed showed that it had an average total carbon content of 1.34%, average organic carbon content of 0.31%, average total sulfur content of 3.23%, and average sulfide sulfur content of 2.15%. One of the roaster trains operated with an average mid-bed temperature of 965° F.(518° C.) and the other roaster train operated with an average mid-bed temperature of 978° F.(525° C.). The off-gas oxygen concentration was controlled at 36% dry basis. The $SO_2$ concentration was maintained at about 9.5% by regular adjustments to the trona addition rate, as needed. The downstream gold recovery from the carbon-in-leach operations yielded about 90% extraction. This compares favorably to prior operations using lime addition to the roaster, that yielded about 88% extraction.

EXAMPLE 2

Newmont also operates a whole ore gold roasting operation in Indonesia: PT Newmont Minahasa Raya (Minahasa). At the Minahasa roaster, the gold ore feed rate is about 2600 tpd of dry feed, at about 0.25 oz Au/short ton, contained in pyrite. Minahasa does not have a sulfuric acid plant, and was originally designed without an $SO_2$ recovery circuit. The dominant minerals in the ore include calcite ($CaCO_3$) and dolomite ($CaCO_3MgCO_3$); and some of the ore contains greater than 20% combined carbonates. These carbonates decrepitate with increasing temperature and increasingly capture $SO_2$, but operate most efficiently at temperatures above the optimum temperature for gold recovery. Gold recovery decreases above the optimum temperature. Thus, the operating temperature chosen is a compromise between minimizing $SO_2$ emissions to acceptable levels and maximizing gold recovery.

Roasting studies on Minahasa roaster feed gold ore have been performed using a 4-inch diameter continuous stationary fluid bed roaster. A major difference from the gold ore at Carlin, Nev., is the higher carbonate levels in the ore, the dominant ores being calcite and dolomite. A major difference in roaster operations from Carlin is that the Minahasa (Mesel) roaster off gas does not feed a sulfuric acid plant. Thus, a major requirement for environmental concerns is maximum sulfur dioxide reduction at Minahasa, in contrast to mere sulfur dioxide process control at Carlin. A detailed description of the operations at Minahasa are described by Weeks, T., McGaffin, I., and Loah, J., "Operational Aspects of Whole Ore Treatment at PT Newmont Minahasa Raya," Randol Gold & Silver Forum, pp. 227–233 (1998).

EXAMPLE 2A

A study of roasting parameters on the effect of off-gas $SO_2$ capture and gold recovery was performed. The roasting parameters included retention time, temperature, oxygen concentration, and additives in the roaster feed. The additives tested were trona, soda ash and hydrated lime.

The roaster feed sample contains 17.87 gram Au/tonne and 1.2% S-sulfide. S-sulfate content is 0.89% and C-carbonate is about 2.29%.

Semiquantitative XRD analysis indicated that the sample contained 62% quartz, 18% dolomite, 4% calcite, and 2% pyrite. Particle size of the sample received is about 78% minus 200 mesh and 60% minus 400 mesh.

Roaster exhaust gas concentrations, including $O_2$, $SO_2$, CO, $CO_2$, and $NO_x$, were monitored continuously by a Rosemount Gas Analyzer during the roasting test. Oxygen concentration was controlled and maintained in the desired level. Roast temperature showed a pronounced effect on $SO_2$ capture. Emission of $SO_2$ in the roaster exhaust gas was reduced as the temperature increased.

Natural sodium sesquicarbonate (Solvay T-50™ trona), soda ash and hydrated lime were used separately as an additive in the roaster feed to assist SO2 capture. The effectiveness of the additives on $SO_2$ capture is in the following order: trona>hydrated lime>soda ash. Under test conditions, soda ash did not show any benefit on sulfur fixation. Addition of trona showed a pronounced effect. A minimum amount of 2 kg trona per tonne of mineral ore was required. The effectiveness of lime for $SO_2$ capture was lower than that of trona. The amount of lime required was higher. In this study, lime addition at 6–8 kg/t of mineral ore was used. Results of $SO_2$ concentration measured in the exhaust gas under test conditions are shown in the following Table 3.

TABLE 3

| | $SO_2$ Concentration in Off Gas, vol. % | | | | |
|---|---|---|---|---|---|
| Roast Temp (° C.) | 3% $O_2$ no additive | 6% $O_2$ no additive | 6% $O_2$ 4 kg/t Soda Ash | 6% $O_2$ 8 kg/t Lime | 6% $O_2$ 2 kg/t Trona |
| 550 | 2.8 | 2.7 | — | — | — |
| 575 | 2.5 | 2.3 | 2.3 | 2.1 | 1.8 |

TABLE 3-continued

| | $SO_2$ Concentration in Off Gas, vol. % | | | | |
|---|---|---|---|---|---|
| Roast Temp (° C.) | 3% $O_2$ no additive | 6% $O_2$ no additive | 6% $O_2$ 4 kg/t Soda Ash | 6% $O_2$ 8 kg/t Lime | 6% $O_2$ 2 kg/t Trona |
| 600 | 2.3 | 2.1 | — | 2.0 | 1.7 |
| 625 | 2.1 | 1.9 | — | — | — |

It is believed that, without intending any limitation to the scope of the invention, one possible explanation of these superior results of $SO_2$ capture with trona, is that trona crystals undergo beneficial physical transformation during the roasting process. The $CO_2$ that is evolved and the water of hydration in the trona that is liberated by the heat from the roaster is believed to cause fractures and pores in the trona crystal that expose additional surface area for reaction with the $SO_2$.

Regarding the gold recovery from roasting products, important factors generally include retention time, oxygen concentration in gas phase and roast temperature. Retention time is an important factor that affects complete sulfide oxidation and the following CIL gold extraction. Higher temperature of 625° C. reduces gold extraction by forming dense rimming iron oxides. Higher oxygen concentration benefits both gold recovery and $SO_2$ emission. In these experimental examples, roast temperature at 575–600° C. yielded the best gold extraction. Gold extraction averaged about 92.5% with 6% oxygen in the roaster. The additives in the roaster feed did not show an effect on gold extraction.

EXAMPLE 2B

Sample Characterization: The head sample was assayed for gold, cyanide leachable gold, sulfur (total and after pyrolysis), carbon (total and acid insoluble), iron and arsenic. The analytical results of the roaster feed sample are given in Table 4.

TABLE 4

| | Assay 1 | Assay 2 | Assay 3/4 | Average |
|---|---|---|---|---|
| Au, g/t | 18.143 | 18.113 | 17.393/ 17.837 | 17.872 |
| AuCN*, g/t | 4.993 | 5.074 | | 5.034 |
| AuCN/Au, % | 27.52 | 28.01 | | 28.17 |
| AuPR*, g/t | 8.107 | 8.195 | | 8.151 |
| Preg-robbing Number, g/t | 0.286 | 0.279 | | 0.283 |
| C-total, % | 4.648 | 4.623 | | 4.636 |
| C-carbonate, % | 2.383 | 2.308 | | 2.346 |
| C-acid insoluble, % | 2.265 | 2.315 | | 2.290 |
| S-total, % | 2.091 | 2.086 | | 2.089 |
| S-sulfate, % | 0.886 | 0.885 | | 0.886 |
| S-sulfide, % | 1.205 | 1.201 | | 1.203 |
| Fe, % | 2.301 | 2.300 | | 2.301 |
| Hg, ppm | 16.6 | 19.3 | | 17.95 |
| As, ppm | 1375.2 | 1486.5 | | 1430.9 |

*AuCN - cyanide extractable gold;
AuPR - pre-robbed gold.

The roaster feed sample contains 17.87 grams Au/tonne and 1.2% S-sulfide. S-sulfate content is relatively high, 0.89%. The C-carbonate content is about 2.29%. The C-acid insoluble content is 2.3%, and mainly is the amount of coal added as a fuel source.

Semiquantitative XRD/XRF analysis indicated that the sample is comprised of 62% quartz, 18% dolomite, 10% illitic clay, 4% calcite, 2% kaolin, 2% pyrite, 1% gypsum, and 1% iron oxides. The XRF analysis indicates that the roaster feed contains 69% $SiO_2$ which is attributed to quartz, illite, and kaolin. Other constituents are 5.3% $Al_2O_3$, attributed to illite and kaolin; 9.7% CaO and 4.7% MgO, attributed to dolomite, calcite and gypsum; and 2.1% Fe attributed to pyrite and iron oxides. Sulfur in the ore is attributed to pyrite and gypsum.

Addition of Trona in the Roaster Feed: Natural sodium sesquicarbonate (Solvay T-50™ trona) was used as an additive in the roaster feed to assist $SO_2$ capture. The trona was received from Solvay Minerals, Green River, Wyo. Ingredients of the trona received include: sodium sesquicarbonate (42–44% of sodium carbonate ($Na_2CO_3$), 33–35% sodium carbonate ($NaHCO_3$), and 14–15% Water ($H_2O$)), and <0.4% Quartz ($SiO_2$). It also contains 6–10% water insoluble species. Roaster tests performed with trona addition ranged from 1, 2 and 4 kg/tonne at 575° and 600° C.

$SO_2$ concentration in the exhaust gas was monitored continuously by the Rosemount Gas Analyzer. The $SO_2$ concentrations in the off-gas as a function of trona addition at 575° C. and 600° C. are illustrated in Table 5.

TABLE 5

| Trona Amount | $SO_2$ Concentration in Off Gas, vol. % | |
|---|---|---|
| (kg/tonne) | Roast Temp 575° C. | Roast Temp 600° C. |
| 0 | 2.3 | 2.1 |
| 1 | 2.5 | 2.25 |
| 2 | 1.8 | 1.7 |
| 4 | 1.9 | 1.7 |

Trona decomposes at the elevated temperature and reacts with $SO_2$ and $SO_3$, thus reducing the $SO_2$ concentration in the exhaust gas. From Table 5, the addition of trona made a pronounced effect on sulfur fixation. From test results, a minimum amount of 2 kg trona per tonne of ore dosage was required, reducing 23% of the $SO_2$ emission in the off-gas. Further increasing the trona dosage to 4 kg/t did not show further improvement of $SO_2$ capture.

For comparison, $SO_2$ concentration in the off-gas was calculated based on solid mass balance, sulfur balance, and gas flow in the system. From sulfur balance calculation, formation of sulfate in the roasting process was increased with increasing amount of trona addition. Results confirmed the sulfur fixation effect with trona.

The effect of trona addition on gold extraction is summarized in Table 6. The overall gold extraction for each roasting test is calculated based on roaster product weight percent and gold extraction obtained from each product.

From test results, it appears that at 575° C., gold extraction was improved about 0.5% (to 92.8%) with the addition of 2 kg/tonne trona and decreased to 91.9% with 4 kg/tonne trona. At 600° C., the highest gold extraction (93%) was obtained with 1 kg/tonne.

TABLE 6

| Trona Amount | Au Extraction % | |
|---|---|---|
| (kg/tonne) | Roast Temp 575° C. | Roast Temp 600° C. |
| 0 | 92.3 | 92.5 |
| 1 | 92.5 | 93.0 |
| 2 | 92.8 | 92.0 |
| 4 | 91.9 | 91.5 |

As noted above, calcite and dolomite, which are sometimes present in gold ores, absorb $SO_2$. Lime (CaO) and hydrated lime {$Ca(OH)_2$} can be added to roaster feed to do the same thing. The fact that trona absorbs $SO_2$ at the optimum temperature for gold roasting is significant for ores like those at Minahasa where the calcite and dolomite present are utilized to absorb all or part of the $SO_2$ evolved. There is a balance between the higher temperatures for more effective capture of $SO_2$ evolved, and the lower temperatures for optimum recovery of the gold.

A hypothetical example of the economic benefits of small changes in gold recovery highlight the potential value of using trona. Some test work on gold ores from Carlin, Nev. indicated that gold recoveries were about 1.5% lower on material roasted at 620° C. than at 600° C. This amounts to a loss of gold value, at a 0.25 oz Au/t feed, of $1.1 3/t. If the temperature can be reduced to the optimum for gold recovery by the addition of trona at a rate of 4 lb/t of ore (at $0.05/lb trona), for example, then the net increase in value by the use of trona is almost a dollar per ton of feed.

Another advantage of using trona as a roaster additive is the ability to accommodate operations differing from the plant design. At most mines, the amount of sulfur in the feed to a roasting plant will have been well-defined during the design process, and the downstream treatment facilities will have been designed to handle this feed, as well as moderate swings in grade. Unless feed conditions change, there may be currently little reason in most operating pyrite roasters to reduce the amount of $SO_2$ emitted from the roaster to the downstream treatment facilities. But, several things could change this: an unexpected increase in the percentage of sulfur to the feed, an increase in the feed rate to the roaster, or changes in the emission limits required. In each of these cases, the addition of trona could be economically beneficial. The trade-off would be the capital or operating cost increase required in order to enhance the existing facilities, versus the cost of adding trona to the roaster feed.

Other advantages of trona are potential enhancements in the arsenic removal by aiding the formation of ferric arsenate complexes.

In addition, the advantages of this invention may be applied to the processing of other mineral ores. The first step in treatment of most zinc concentrates is roasting, which is almost always done now in fluid bed roasters. Zinc concentrates will typically contain about 30–35% sulfur and 50–55% zinc, and are roasted at a temperature of about 900–950° C. All zinc refineries in Canada and North America that utilize roasting have acid plants for treatment of the roaster off-gasses.

Other potential applications of this invention include copper recovery. As in the zinc refining process, roasting of copper concentrate from the flotation process, then leaching of the roasted copper concentrate, has been carried out at a few operations. Likewise, Molybdenite ($MoS_2$) concentrates are roasted to molybdenum trioxide for further processing.

Of course, it should be understood that changes and modifications can be made to the preferred embodiments described above. It is therefore intended that the foregoing detailed description be regarded as illustrative rather than limiting, and that it be understood that it is the following claims including all equivalents, which are intended to define the scope of this invention.

What is claimed is:

1. A method for controlling off gas emissions from a mineral ore roaster comprising:

grinding a sulfur-containing mineral ore;

adding sodium sesquicarbonate to the mineral ore; and roasting the mineral ore and sodium sesquicarbonate at an elevated temperature sufficient to oxidize the sulfidic material contained in the ore, and sufficient to fix at least some of the resultant sulfur dioxide.

2. The method of claim 1 wherein the sodium sesquicarbonate is in the form of mechanically refined trona.

3. The method of claim 1 wherein the trona has a particulate size such that about 86 weight percent of the trona is retained on a 100 mesh screen.

4. The method of claim 2 wherein the temperature is between about 475° C. and about 750° C.

5. The method of claim 2 wherein the amount of trona added to the mineral ore is less than 10 kg/tonne ore.

6. The method of claim 5 wherein in the amount of trona is more than 2 kg/tonne ore.

7. The method of claim 1 wherein the mineral ore is gold ore.

8. The method of claim 7 wherein the gold ore is a refractory sulfide gold ore.

9. A method for treating mineral ore, ore concentrates, or combinations thereof having recoverable precious metal values and including sulfur-containing components, the method comprising:

adding sodium sesquicarbonate to said ore, ore concentrates, or combinations thereof;

roasting said ore, ore concentrates, or combinations thereof in the presence of sodium sesquicarbonate at elevated temperatures sufficient to oxidize the sulfur-containing components, wherein the sodium sesquicarbonate is present in amounts sufficient to fix at least a portion of the sulfur dioxide created by oxidization of the sulfur-containing components;

measuring the concentration of sulfur dioxide in the off gas generated by the roasting;

adjusting the amount of sodium sesquicarbonate added to the mineral ore, ore concentrates, or combinations thereof in response to the difference between the measured concentration of sulfur dioxide and a predetermined concentration of sulfur dioxide; and recovering the roasted ore as a calcine whereby the precious metal value may be recoverable from the calcine.

10. The method of claim 9 wherein the sodium sesquicarbonate is in the form of mechanically refined trona.

11. The method of claim 10 wherein the trona has a particulate size such that about 86 weight percent of the trona is retained on a 100 mesh screen.

12. The method of claim 10 further comprising grinding the trona and the ore, ore concentrates or combinations thereof together before roasting the mixture.

13. The method of claim 12 wherein the trona and ore mixture are ground to a particulate size such that about 68 weight percent will pass through a 400 mesh screen.

14. The method of claim 10 wherein the temperature is between about 475° C. and about 750° C.

15. The method of claim 14 where the temperature is between about 500° C. and about 625° C.

16. The method of claim 9 wherein the predetermined concentration of sulfur dioxide is between about 4% and about 12%.

17. The method of claim 16 wherein the predetermined concentration of sulfur dioxide is about 9.5%.

18. The method of claim 10 wherein the trona is added in an amount less than 10 kg/tonne ore.

19. The method of claim 17 wherein the trona is added in an amount of more than 2 kg/tonne ore.

20. The method of claim 9 wherein the roasting is performed in an oxygen-enriched atmosphere.

21. The method of claim 9 wherein the method is conducted in a continuous process operation.

22. A method for controlling off gas emissions from a mineral ore roaster comprising:

introducing a mineral ore containing sulfidic material into a roaster;

introducing sodium sesquicarbonate into the roaster; and roasting the mineral ore and sodium sesquicarbonate at an elevated temperature sufficient to oxidize the sulfidic material contained in the ore, and sufficient to fix at least a portion of the resultant sulfur dioxide.

23. The method of claim 14 wherein the sodium sesquicarbonate is in the form of mechanically refined trona.

24. The method of claim 14 wherein the temperature is between about 475° C. and about 750° C.

25. The method of claim 22 wherein the mineral ore is in the form of an ore concentrate.

* * * * *